United States Patent [19]

Jones, Jr.

[11] Patent Number: 4,991,595

[45] Date of Patent: Feb. 12, 1991

[54] SELF-EXTINGUISHING CIGARETTE WITH FAIL-SAFE TILT-RING

[76] Inventor: Roscoe Jones, Jr., Louisiana State Penitentiary, Angola, La. 70712

[21] Appl. No.: 365,210

[22] Filed: Jun. 12, 1989

[51] Int. Cl.[5] ..... A24F 13/02

[52] U.S. Cl. ..... 131/175

[58] Field of Search ..... 131/175

[56] References Cited

U.S. PATENT DOCUMENTS

| | | | |
|---|---|---|---|
| 1,664,937 | 4/1928 | Maloney | 131/175 |
| 2,248,418 | 7/1941 | Steinberg . | |
| 2,346,067 | 4/1944 | Di Rubbio | 131/175 |
| 2,644,463 | 7/1953 | Wheelock . | |
| 2,823,679 | 2/1958 | Vrana . | |
| 2,932,301 | 4/1960 | Tabara . | |
| 3,827,444 | 8/1974 | Khan . | |
| 3,916,916 | 11/1975 | Bramucci . | |
| 4,289,149 | 9/1981 | Kyriakou . | |
| 4,409,997 | 10/1983 | Lehman . | |
| 4,570,645 | 2/1986 | Newman, Sr. et al. . | |
| 4,572,217 | 2/1986 | Newman, Sr, et al. . | |
| 4,682,611 | 7/1987 | Chiu-Rong . | |
| 4,703,766 | 11/1987 | Wargo . | |
| 4,709,706 | 12/1987 | Tuno . | |

FOREIGN PATENT DOCUMENTS

| | | |
|---|---|---|
| 32014 | 4/1952 | Australia . |
| 622411 | 4/1981 | Switzerland . |
| 6633 | of 1912 | United Kingdom . |
| 340362 | 1/1931 | United Kingdom . |

*Primary Examiner*—V. Millin
*Assistant Examiner*—Jennifer L. Doyle
*Attorney, Agent, or Firm*—Reginald F. Roberts, Jr.

[57] ABSTRACT

A self-extinguishing cigarette equipped with fail-safe means for fire prevention and improved means for holding the cigarette. The cigarette is disposed and held within a hollow, perforated tube to which the supply of air is limited. In one embodiment of the invention, a tilt-ring is fastened to the outer surface of the tube so that, if the tube holding the cigarette is placed upon a horizontal surface such as a bed or carpet, the tube will tilt and bring the unlit end of the cigarette to rest on the horizontal surface. In a second embodiment, a pair of tilt-rings are provided, one ring at each end of the tube, so that the entire tube and cigarette are held above and away form the horizontal surface. The preferred means for limiting the supply of air to the cigarette include tubal perforations of about one-thirty-second of an inch, separated by an average distance of about one-quarter of an inch.

20 Claims, 2 Drawing Sheets

SELF-EXTINGUISHING CIGARETTE WITH FAIL-SAFE TILT-RING

BACKGROUND OF THE INVENTION

The present invention relates to cigarettes. More particularly, the invention relates to safeguarding cigarettes from becoming a source of fire.

One of the common causes of death by fire is related to the smoking of cigarettes in bed. Aircraft fires attributable to ignition of plastic furnishings by cigarettes dropped or set aside carelessly have caused their deaths. Other circumstances include forest fires and house fires originating from carpets and furniture, traceable to similar situations. In all of these instances, the source of ignition is the burning end of the cigarette.

One of the most critical problems confronting developers of cigarettes and cigarette manufacturers has been how to make a cigarette which will automatically self-extinguish if the smoker fails to continue drawing on the cigarette. The National Fire Association has concluded that cigarettes provided the source of ignition for over thirty-five percent of one and two-fatality fires in the United States from 1971 to 1978. The Association further concluded that 16.9% of the fires were caused by cigarettes' igniting bedding in sleeping areas.

In an effort to reduce the frequency of such fires, the National Fire Association and several other associations have endorsed a Cigarette Safety Act which would stipulate that all cigarettes and small cigars made in the United States should self-extinguish within five minutes if left unattended. Cigarettes will normally burn for a maximum of twenty-four minutes if left unattended. Proponents for the aforesaid safety legislation have estimated that hundreds of lives could be saved and thousands of costly fires prevented every year if a self-extinguishing cigarette were developed.

In response to these demands a number of self-extinguishing cigarettes and cigarette-holders have been invented and patented. Prominent and important examples include those disclosed by U.S. Pat. Nos. 4,570,645 and 4,572,217 to Newman, Sr., et al., and U.S. Pat. No. 4,703,766 to Wargo. These patents are incorporated herein by reference.

While the patents cited above disclose important developments in the state of the art, they fail to provide a fail-safe mechanism or means for preventing the burning tip of the cigarette from contacting or closely approaching any horizontal surface on which the cigarette or cigarette-holder may be resting. Thus, self-extinguishing cigarettes as disclosed by the above patents, if thrown from the windows of automobiles, dropped on a rug or a bed, or allowed to come into close proximity of or in direct contact with the surface of a flammable material such as most plastics, dry grass, or bed linen, could possible ignite such material and start a fire. Even though the burning tip should be shielded from direct contact with the flammable material, the possibility exists that very close proximity of the tip to the flammable surface would cause the latter to ignite.

SUMMARY OF THE INVENTION

In general, the present invention in one aspect provides a self-extinguishing cigarette. This embodiment of the invention comprises a perforated, hollow, elongated member of slightly greater cross-sectional area than a cigarette, which is coaxially disposed within the elongated member. Means are provided for holding the cigarette in the elongated member, for limiting the supply of air to the cigarette, and for separating the outer surface of the elongated member from a horizontal surface supporting the elongated member.

In a second aspect the invention provides a holder for a cigarette, and particularly for a self-extinguishing cigarette. The cigarette-holder comprises a perforated, hollow, elongated member of slightly greater cross-sectional area than a cigarette; means for holding a cigarette coaxially disposed within the elongated member; means for separating the outer surface of the elongated member from a horizontal surface supporting the elongated member.

In a third aspect the present invention provides an improvement over existing cigarette-holders, and in particular over existing self-extinguishing cigarette-holders. The improvement comprises means for separating the outer surface of an elongated member holding the cigarette from a horizontal surface supporting the elongated member.

DETAILED DESCRIPTION OF THE INVENTION

More specifically, three embodiments of the present invention are shown schematically in FIGS. 1–4.

A common feature of all self-extinguishing cigarettes and cigarette-holders is the provision of a perforated tube which encloses and holds the cigarette. The perforated, hollow, elongated member 4 shown in FIGS. 1–4 illustrates this common feature. It is to be understood, however, that other elements, features, and designs may be included therein, e.g. the internal ring-barriers (30) disclosed by Newman, Sr. et al. in U.S. Pat. No. 4,570,645. The elongated member 4 is used to represent quite generally any perforated hollow tube utilized as a holder for a self-extinguishing cigarette.

Figure 1:
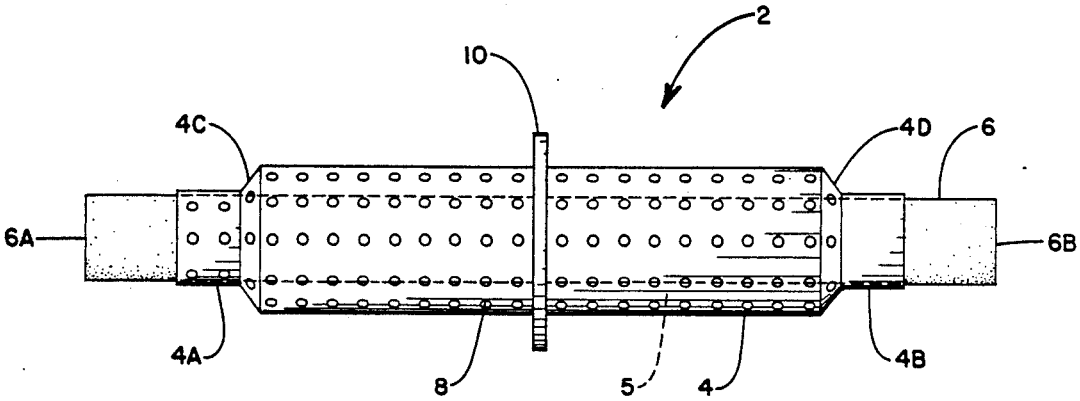
FIG. 1 is a schematic representation of a first embodiment of a self-extinguishing cigarette provided with a tilt member, made in accordance with the principles of the present invention.
Figure 2:
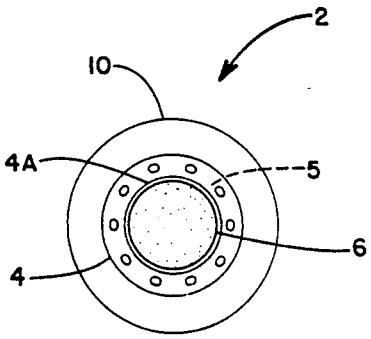
FIG. 2 is an end view of the same.

Reference is now made to FIGS. 1 and 2, wherein is shown a first embodiment of a self-extinguishing cigarette made in accordance with the principles of the present invention, and generally designated by the numerals 2. The self-extinguishing cigarette 2 comprises a perforated, hollow, elongated member 4 in which is disposed and held, by a pair of flanges 4*a*, 4*b* or other means, a cigarette 6, with an annular space 5 between the cigarette 6 and the elongated member 4. The air supply to the cigarette 6 is limited by the size and spacing of the perforations 8, as well as by other means such as internal ring-barriers as disclosed by Newman, Sr. et al. The end 6*a* of the cigarette 6 is for lighting, and the end 6*b* for drawing on the cigarette.

A transverse member 10 is fastened perpendicularly to the outer surface of the elongated member 4 at or near the midpoint of the length of the member 4. Hereinafter the transverse member 10 will be referred to as a tilt-ring, and the elongated member 4 will be referred to as a tube, with the expressed understanding that neither need be circular or cylindrical, and that the terms are not to be taken to designate any particular shape or geometry. Preferably, however, the tube 4 is cylindrical, the perforations 8 are circular, and the tilt-ring 10 is an annular plate.

The tilt-ring 10 provides a fail-safe device in the event the burning cigarette 6 is discarded in such a manner that the tube 4 would, in the absence of the tilt-ring 10, rest along its entire length on a supporting horizontal surface which could be flammable. Such a situation is easy to specify: the tube 4 holding the cigarette 6 thrown from an automobile onto a carpet of leaves or dry grass; the tube holding the cigarette allowed to fall upon a combustible carpet; the tube holding the cigarette dropping from the hand of a sleeping person onto a bed, a sheet, or a mattress. In all of these instances, the only preventive of possible fire is the self-extinguishing feature of the cigarette. If this feature were to fail, or if contact between the burning tip of the cigarette, hot cigarette ash, or intense heat transferred by radiation and convection from the incandescent tip to the surface through the perforations 8 occur before self-extinguishment, the stage would be set for a possible conflagration.

With the tilt-ring 10 in place, however, the tube 4 will tilt onto the unlit end **6*b* of the cigarette 6 or onto the non-perforated flange 4*b*. By tilting the lower outer surface of the tube 4 away from a horizontal support, the tilt-ring 10 effectively prevents an incipient fire and permits the discarded self-extinguishing cigarette 2** to "fail safe."

Figure 3:
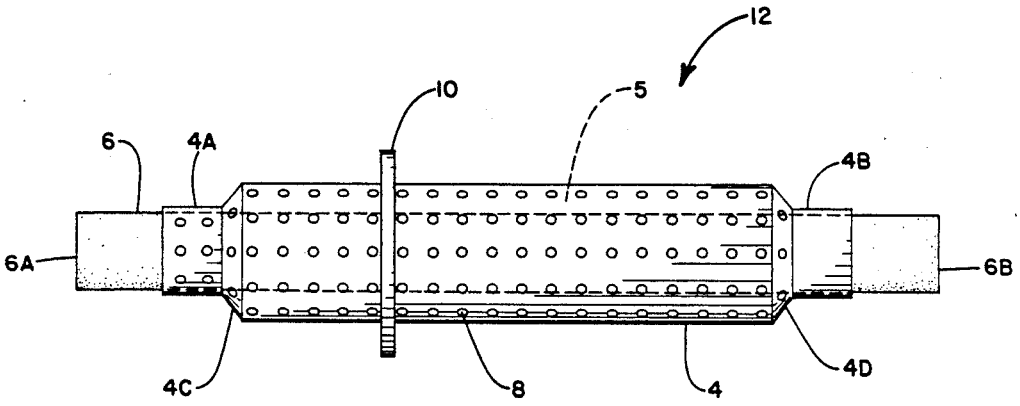
FIG. 3 is a schematic representation of a second embodiment of a self-extinguishing cigarette provided with a tilt member, made in accordance with the principles of the present invention.

Referring now to FIG. 3, which shows a second embodiment of a self-extinguishing cigarette 12 made in accordance with the principles of the present invention, it will be apparent that, under the circumstances described above, the tube 4 and cigarette 6 will be tipped so that the end **6*b* of the cigarette 6 contacts the horizontal surface. If a mouthpiece (not shown) is provided, the mouthpiece should be disposed at the end 4*d* of the tube 4; i.e., at the end which is farther away from the tilt-ring 10 and which is adjacent to the non-perforated flange 4*b***.

Figure 4:
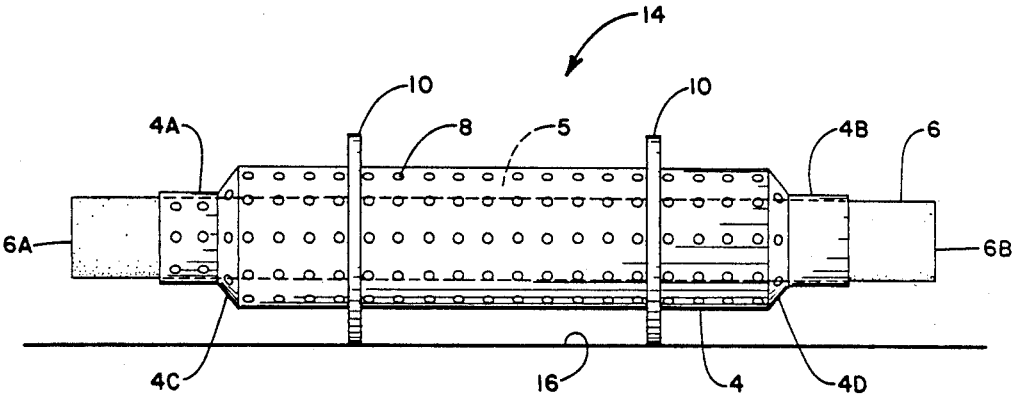
FIG. 4 is a schematic representation of a third embodiment of a self-extinguishing cigarette provided with a pair of tilt members, made in accordance with the principles of the present invention.

FIG. 4 shows a third embodiment, designated 14, of a self-extinguishing cigarette made in accordance with the principles of the present invention. The third embodiment 14 comprises a first tilt-ring 10 fastened to the tube 4 near one end **4*a* thereof, and a second tilt-ring 10 fastened to the tube near its other end 4*b*. It will be apparent that, for this embodiment, the pair of tilt-rings 10 act to prevent either end of the tube 4 or cigarette 6 from making contact with a horizontal surface 16 on which the self-extinguishing cigarette combination 14 has come to rest, as well as to prevent contact between the horizontal surface 16 and the tube 4** along its entire length.

Of the three embodiments 2, 12, and 14 of the present invention, the second and third embodiments 12 and 14 are preferred; and the third embodiment 14 is most preferred.

While air-limiting means such as those disclosed by Newman, Sr. et al. and by Wargo are included within the scope of the improvement provided by the tilt-rings 10 of the present invention, other modifications, including those presently unknown, are likewise included. For example, since a non-perforated tube would cause the cigarette to self-extinguish even when drawn upon, and since the pattern of perforations disclosed by Newman, Sr. et al. and by Wargo are too large or too widely spaced to cause, in the absence of other air-limiting means, the cigarette to self-extinguish, it follows that there must be some combination or combinations of hole size and hole separation which, along and per se, would accomplish the same objective and perform the same function. Such a combination would clearly lie within the scope of the present invention.

This inference has been confirmed. Using smaller perforations than those previously disclosed, the present inventor has had a working model made and successfully tested. The model utilizes circular perforations which are about one-thirty-second of an inch in diameter, with an average spacing between perforations of about one-quarter of an inch. The tube 4 as actually used in the working model was open at both ends, was fabricated of aluminum, had an outside diameter of five-eighths of an inch, and a thickness of seventy-five one-thousandths of an inch. Other materials may of course be used, as taught, for example, in the prior-art patents. In the test conducted on the working model, it was found that the cigarette self-extinguished within about forty-five second after the last "puff" had been taken.

The preferred embodiment of this latest invention includes a pair of tilt-rings 10, which, if fabricated so as to include a straight portion or straight member, would provide a self-extinguishing cigarette-holder which could be used to support the cigarette on a desk or table.

I claim:

1. A self-extinguishing cigarette, comprising:

(a) a perforated first hollow, elongated member of greater cross-sectional area than a cigarette;

(b) a cigarette coaxially disposed within the first elongated member;

(c) means for holding the cigarette in the first elongated member, said means including a perforated second hollow, elongated member disposed at one end of the first elongated member, and a third hollow, elongated member disposed at the other end of the first elongated member, the second and third elongated members having an internal diameter adapted to having a cigarette fitted therein;

(d) means for limiting the supply of air to the cigarette; and (e) means for separating the outer surface of the first elongated member from a horizontal surface supporting the first elongated member.

2. The self-extinguishing cigarette of claim 1, wherein the means for separating the surface of the elongated member from the horizontal surface include a transverse member fastened to the outer surface of the elongated member in a substantially perpendicular configuration.

3. The cigarette of claim 2, wherein the transverse member is disposed near the longitudinal center of the elongated member.

4. The cigarette of claim 2, wherein the transverse member is disposed near one end of the elongated member.

5. The self-extinguishing cigarette of claim 4, further including a second transverse member fastened to the outer surface of the elongated member in a substantially perpendicular configuration near the other end of the elongated member.

6. A holder for a self-extinguishing cigarette, comprising:

(a) a perforated first hollow, elongated member of slightly greater cross-sectional area than a cigarette;

(b) means for holding a cigarette coaxially disposed within the first elongated member, said means including a perforated second hollow, elongated member disposed at one end of the first elongated member, and a third hollow, elongated member disposed at the other end of the first elongated member, the second and third elongated members having an internal diameter adapted to having a cigarette fitted therein;

(c) means for limiting the supply of air to the cigarette; and (d) means for separating the outer surface of the first elongated member from a horizontal surface supporting the first elongated member.

7. The cigarette-holder of claim 6, wherein the means for separating the surface of the elongated member from the horizontal surface include a transverse member fastened to the outer surface of the elongated member in a substantially perpendicular configuration.

8. The cigarette-holder of claim 7, wherein the transverse member is disposed near the longitudinal center of the elongated member.

9. The cigarette-holder of claim 7, wherein the transverse member is disposed near one end of the elongated member.

10. The cigarette-holder of claim 9, further including a second transverse member fastened to the outer surface of the elongated member in a substantially perpendicular configuration near the other end of the elongated member.

11. A self-extinguishing cigarette-holder which includes a perforated first hollow, elongated member of slightly greater cross-sectional area than a cigarette; means for holding a cigarette coaxially disposed with the first elongated member; and means for limiting the supply of air to the cigarette, the improvement comprising:

(a) means for separating the outer surface of the first elongated member from a horizontal surface supporting the elongated member; and (b) a perforated second hollow, elongated member disposed at one end of the first elongated member, and a third hollow, elongated member disposed at the other end of the first elongated member, the second and third elongated members having an internal diameter adapted to having a cigarette fitted therein, thereby providing improved means for holding the cigarette within the first elongated member.

12. The improvement recited in claim 11, wherein the means for separating the surface of the elongated member from the horizontal surface include a transverse member fastened to the outer surface of the elongated member in a substantially perpendicular configuration.

13. The improvement recited in claim 12, wherein the transverse member is disposed near the longitudinal center of the elongated member.

14. The improvement recited in claim 12, wherein the transverse member is disposed near one end of the elongated member.

15. The improvement recited in claim 14, further including a second transverse member fastened to the outer surface of the elongated member in a substantially perpendicular configuration near the other end of the elongated member.

16. The improvement recited in claim 11, further comprising:

providing a plurality of perforations in the surface of the elongated member which are approximately one-thirty-second of an inch in diameter, and which are separated from one another by an average distance of about one-quarter of an inch.

17. A holder for a self-extinguishing cigarette, comprising:

(a) a first hollow, elongated member of slightly greater cross-sectional area than a cigarette, the elongated member being open at both ends and including perforations in its surface of about one-thirty-second of an inch in diameter, the perforations separated from one another by an average distance of about one-quarter of an inch; and (b) means for holding the cigarette coaxially disposed within the first elongated member said means including a perforated second hollow, elongated member disposed at one end of the first elongated member, and a third hollow, elongated member at the other end of the first elongated member, the second and third elongated members having an internal diameter adapted to having a cigarette fitted therein.

18. The self-extinguishing cigarette-holder of claim 17, further comprising:

(c) means for separating the outer surface of the first elongated member from a horizontal surface supporting the first elongated member.

19. A self-extinguishing cigarette, comprising:

(a) a perforated first hollow, elongated member having a cross-sectional area slightly greater than that of a cigarette;

(b) a cigarette coaxially disposed within the first elongated member;

(c) a perforated second hollow, elongated member disposed at one end of the first elongated member;

(d) a third hollow, elongated member disposed at the other end of the first elongated member, the second and third elongated members having an internal diameter adapted to having a cigarette fitted therein; and (e) means for limiting the supply of air to the cigarette.

20. A holder for a self-extinguishing cigarette, comprising:

(a) a perforated first hollow, elongated member of slightly greater cross-sectional area than a cigarette;

(b) a perforated second hollow, elongated member disposed at one end of the first elongated member;

(c) a third hollow, elongated member disposed at the other end of the first elongated member, the second and third elongated members having an internal diameter adapted to having a cigarette fitted therein, thereby providing means for holding a cigarette within the first elongated member; and (d) means for limiting the supply of air to the cigarette.

* * * * *